United States Patent [19]

Schwartzenberger

[11] Patent Number: 4,550,643

[45] Date of Patent: Nov. 5, 1985

[54] FASTENER DRIVING TOOL

[75] Inventor: Julius W. Schwartzenberger, Chicago, Ill.

[73] Assignee: Duo-Fast Corporation, Franklin Park, Ill.

[21] Appl. No.: 606,153

[22] Filed: May 2, 1984

[51] Int. Cl.[4] ..... F15B 11/15

[52] U.S. Cl. ..... 91/356; 91/461; 227/8

[58] Field of Search ..... 91/356, 220, 461; 227/8, 130

[56] References Cited

U.S. PATENT DOCUMENTS

| | | | |
|---|---|---|---|
| 3,278,105 | 10/1966 | Juilfs et al. | 91/220 |
| 3,547,003 | 12/1970 | Ramspeck | 91/300 |
| 3,638,532 | 2/1972 | Novak | 91/220 |
| 3,677,456 | 7/1972 | Ramspeck | 91/356 |
| 3,677,457 | 7/1972 | Ramspeck | 91/356 |

*Primary Examiner*—Paul E. Maslousky

*Attorney, Agent, or Firm*—Mason, Kolehmainen, Rathburn & Wyss

[57] ABSTRACT

A fastener driving tool includes a control assembly that allows the tool to be fired sequentially by first placing the tool against a workpiece followed by actuation of a trigger to fire the tool. The control assembly includes a valve assembly that allows the tool to be selectively adjusted to operate in a multi-shot sequence or a single shot sequence. In the single shot sequence the tool may only be actuated once upon placement of the tool against a workpiece and subsequent actuation of the trigger. The tool must be removed and repositioned on the workpiece before the tool can again be fired. In the multi-shot sequence, the tool may be repeatedly fired by repeated actuation of the trigger once the tool has been placed on the workpiece.

12 Claims, 15 Drawing Figures

10
28
32
24
34
12
36
26
98
30
92
14
88
96
18
38
22
86
20
90
16
100
40
94
108
86
16
64
56
46
54
84
60
22
66
42
68
48
44
50
52
106
62
102
74
104
80

218
210
266
264
220
216
214
244
236
268
234
272
270
224
212
R
232
238
222
248
250
258
226
252
228
230
242
246
240
256
254
S
260
262
271

FASTENER DRIVING TOOL

BACKGROUND OF THE INVENTION

A. Field of the Invention

The present invention relates to a new and improved fastener tool with a single control that may be adjusted to place the tool in a single shot sequential fire mode or a multi-shot sequential fire mode.

B. Description of the Background Art

There are fastener driving tools available with control systems that allow touch trip firing. Touch trip firing allows the tool to be fired either by depressing the safety first and then the trigger or the trigger first followed by depressing the safety.

For safety purposes many fastener driving tools include a sequential fire control requiring the safety of the tool to be actuated by first placing the tool against a workpiece. Once the safety is actuated, a trigger may be actuated to fire the tool.

More stapling and nailing equipment users are requiring sequential fire controls to be provided on fastener driving tools. Some of the users with the strictest standards require both the trigger and the safety to be released each time the tool is to be fired. This mode of operation is designated the single-shot, sequential fire mode. Tool operation in this mode increases the time required to place a given number of fasteners in a workpiece.

There are other applications, however, in which safe operation is achieved by keeping the nose of the tool against the workpiece and cyclically actuating and releasing the trigger. This latter mode is termed the multi-shot sequential fire mode.

There is a distinct advantage, both from the viewpoint of manufacturing and inventory requirements, to be able to achieve both of these modes of operation with a single tool or single tool control.

A basic fastener driving tool with a trigger control valve, a safety control valve and a cycling valve is disclosed in U.S. Pat. No. 3,638,532. This tool with a manual control for selecting single or multiple cycles of operations is disclosed in U.S. Pat. No. 3,547,003. Sequential fire control, either solely pneumatic or pneumatic and mechanical is disclosed in U.S. Pat. No. 3,677,457 (combined mechanical -pneumatic control) and U.S. Pat. No. 3,677,456 (an all pneumatic arrangement).

None of the tools disclosed in these patents includes a single control that can be easily adjusted between the single shot and multi-shot, sequential modes of operation. Such an adjustment feature is of significant value since it allows the manufacturer to easily adjust each tool to the specific mode of fire control desired by the purchaser.

SUMMARY OF THE INVENTION

An object of the present invention is to provide a new and improved fastener driving tool.

Another object of the present invention is to provide a new and improved fastener driving tool including a single control adjustable between two modes of sequential fire operation.

A still further object of the present invention is to provide a new and improved fastener driving tool that includes a plug valve and related passages that function under the control of signal pressure during a multi-shot, sequential fire mode to return a cycle valve to a normal, static position allowing automatic return of a driver piston.

Briefly, the present invention is directed to a new and improved fastener driving tool that operates in one of two sequential fire modes to drive fasteners into a workpiece. The tool includes a housing defining a fluid reservoir. A driver is reciprocally mounted in the housing and a fluid actuated motor in the housing drives the driver. A return assembly is also included for returning the driver at the completion of a driving stroke. The tool includes a control assembly for controlling the flow of pressurized fluid to the motor. The control assembly includes a safety, a trigger valve, a cycle valve and a plug valve. Through the use of a needle valve and selected passages, the control assembly may be configured to place the tool in either a single shot or multi-shot sequential fire mode.

BRIEF DESCRIPTION OF THE DRAWINGS

The above and other objects and advantages and novel features of the present invention will become apparent from the following detailed description of a preferred embodiment of the invention illustrated in the accompanying drawings wherein.

DETAILED DESCRIPTION OF THE PREFERRED EMBODIMENT

Figure 1:
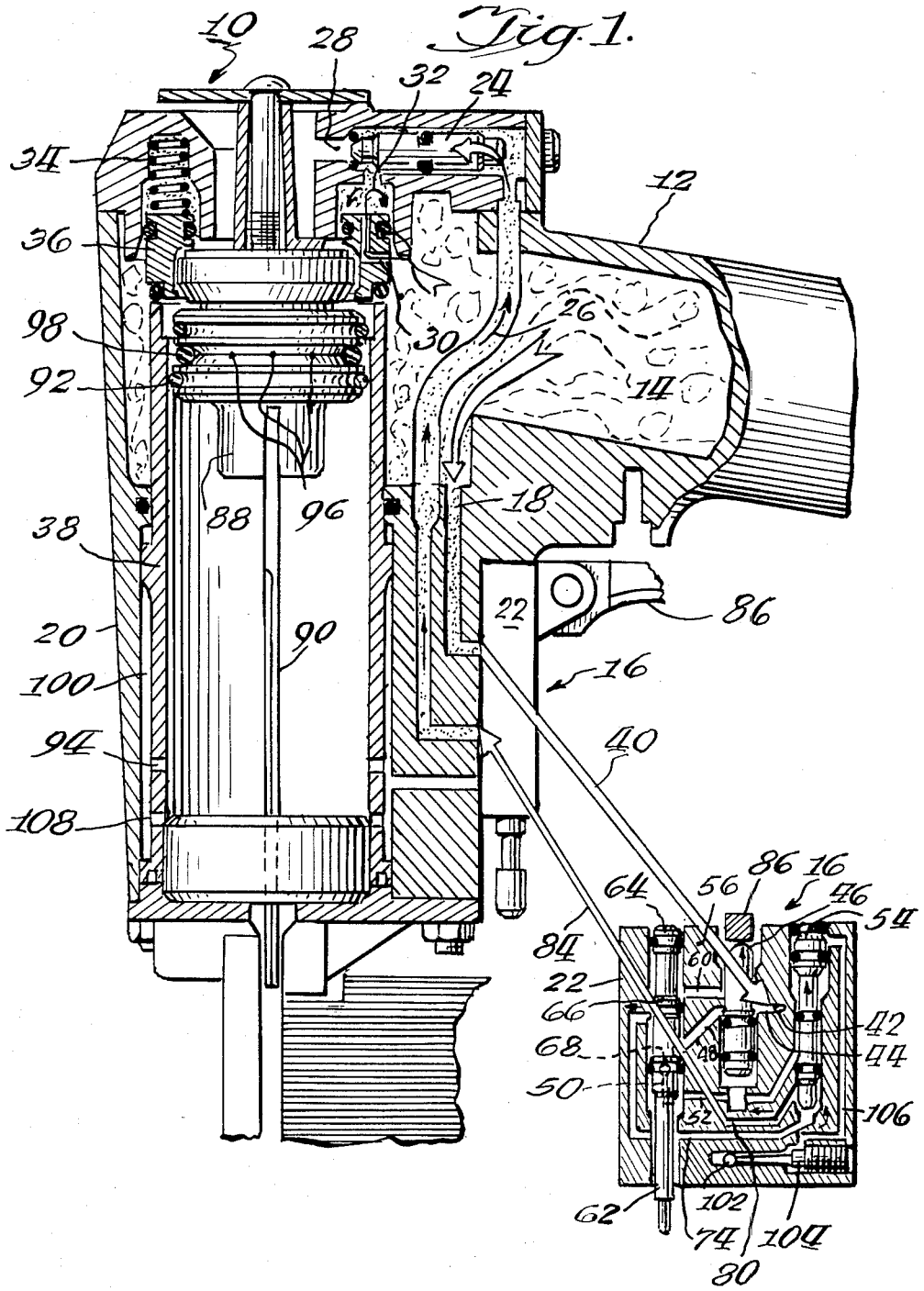
FIG. 1 is a partially cut away view of a known touch trip tool with the valve housing detached and rotated to illustrate the trigger valve, safety and cycle valve.

Referring to the drawings and initially to FIGS. 1–4, there is illustrated a standard touch trip fastener driving tool 10. Tool 10 is similar to the tool disclosed in U.S. Pat. No. 3,638,532 and this patent is incorporated by reference. The elements different than those found in the '532 patent and necessary for the understanding of the present invention will be explained. Additional details, if desired, may be obtained by reference to the '532 patent.

Tool 10 includes a handle 12 defining a reservoir 14 for containment of pressurized fluid such as air. Pressurized fluid in reservoir 14 is communicated to a control valve generally designated by the reference numeral 16 by a passage 18 in the tool housing 20. Control valve 16 is contained in a valve housing 22 removably secured to the tool housing 20.

Control valve 16 controls fluid flow from reservoir 14 to a dump valve 24 through a tube 26. In the static mode of tool 10 illustrated in FIG. 1, fluid pressure communicated to the dump valve 24 biases dump valve 24 into sealing engagement with an exhaust vent 28 allowing pressure that is communicated through a passage 30 to build up in a poppet chamber 32. Pressurization of the poppet chamber 32 reinforces the effect of poppet spring 34 to seal poppet 36 against cylinder 38.

In the static mode, pressurized air is introduced into control valve 16 as indicated by arrow 40 at passage 42. Passage 42 is in communication with passage 44. Air flows along passage 44, across trigger valve 46, along passages 48, 50 and 52 at which location air flow is stopped by cycle valve 54. Air also flows along trigger valve 46 through openings 56 and 58 to passage 60 and opening 61 in safety 62 where it is trapped between diameters 64 and 66.

Air also flows through opening 68 in passage 48 and along safety 62 to opening 70. This air then flows along passages 72 and 74 to beneath cycle valve 54 through opening 76. Air flowing through opening 76 flows along cycle valve 54 to opening 78 and into passage 80. Air in passage 80 is introduced through opening 82 to tube 26 as indicated by arrow 84.

Figure 2:
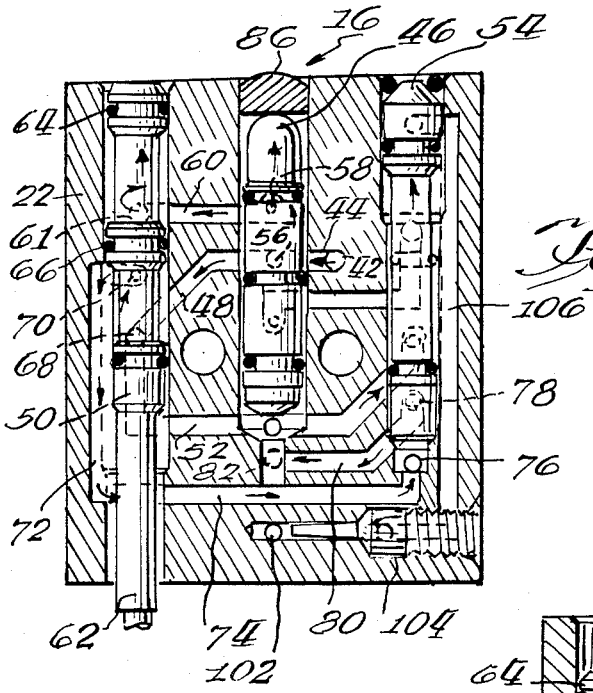
Fig. 2 PRIOR ART
FIG. 2 is a pictorial view of the valve housing in the static mode.
Figure 3:
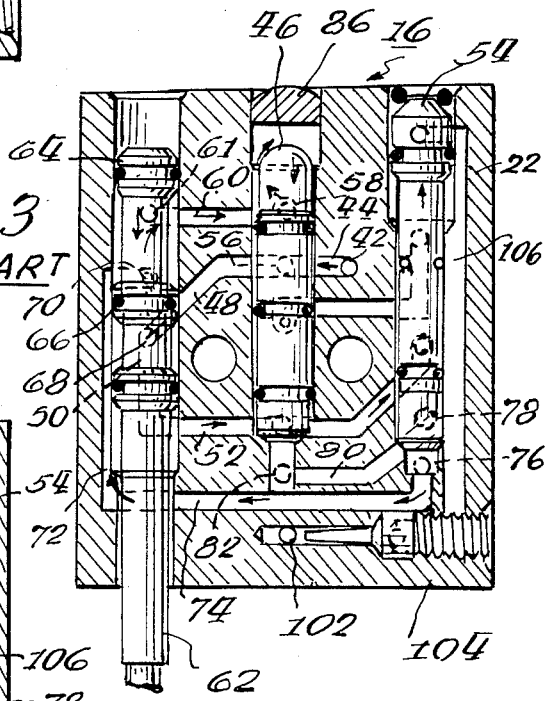
Fig. 3 PRIOR ART
FIG. 3 is a view similar to FIG. 2 with the valve housing in the fire mode.
Figure 4:
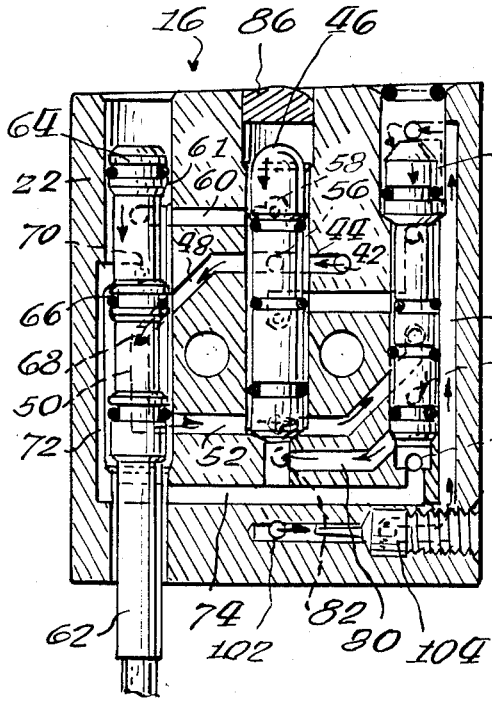
Fig. 4 PRIOR ART
FIG. 4 is a view similar to FIGS. 2 and 3 with the valve housing in the return mode.

In the static mode of tool 10 as illustrated in FIGS. 1 and 2, reservoir air is supplied to the poppet or dump valve 24 through the control valve 16. Once there is a drop in pressure to the poppet valve 24, tool 10 will fire. Two direct avenues supply reservoir air to the poppet valve 24; through safety 62 and through the trigger valve 46. If both avenues are cut off, tool 10 will fire.

To fire tool 10 safety 62 is shifted downward by placing the tool 10 onto a workpiece and the trigger valve 46 is shifted downward by actuation of trigger 86. Safety 62 and trigger valve 46 are shifted to the positions illustrated in FIG. 3. Air from reservoir 14 is prevented from entering the dump valve 24 and the pressure accumulated in the dump valve 24 in the static mode is now exhausted to atmosphere along passages 80, 74, 72 and 68 and along trigger valve 46. With the dump valve 24 depressurized, pressure in poppet chamber 32 shifts dump valve 24 allowing pressure in poppet chamber 32 to vent to atmosphere through vent 28. Reservoir air is then introduced to chamber 36 above piston drving driver 90 through a driving stroke. As vent gland 92 passes port 94, reservoir air rushes through ducts 96 in piston 88 expanding O-ring 98 to charge return chamber 100.

Tool 10 is now ready to return piston 88 and recycle. Air in return chamber 100 is communicated to port 102 in valve housing 16 (FIG. 4) and passes through needle valve 104 to passage 106 to a location above cycle valve 54. Cycle valve 54 is shifted down reestablishing the circuit from reservoir 14 to dump valve 24 through passages 48, 50, 52 and 80. Dump valve 24 shifts into sealing engagement with vent 28 pressurizing poppet chamber 32 and terminating flow of reservoir air into cylinder 38. Simultaneously, air in return chamber 100 exhausts through port 108 forcing the return of piston 88. An upward shift of either safety 62 or trigger valve 46 produced either by lifting tool 10 from the workpiece or releasing trigger 86 allows reservoir air to shift cycle valve 54 up to reestablish the static mode.

Tool 10 is not acceptable under certain users standards. Many users require sequential fire capability and the facility to set the tool to either single shot or multi-shot firing action. A tool meeting these demands may be of the type of tool 10 illustrated in FIG. 1 but with a control valve 210 illustrated in FIGS. 5–15. With the control valve 210, reservoir air is supplied to dump valve 24 by two avenues. One is with the cycle valve 212 biased down to its static position and the other is with the cycle valve 212 biased down by way of the safety 214 and a plug valve 216. In either of these conditions, however, tool 10 will fire only if the safety 214 is depressed first which results in poppet 36 receiving air from one mechanical source. If another sequence is followed, tool 10 cannot be fired.

Figure 5:
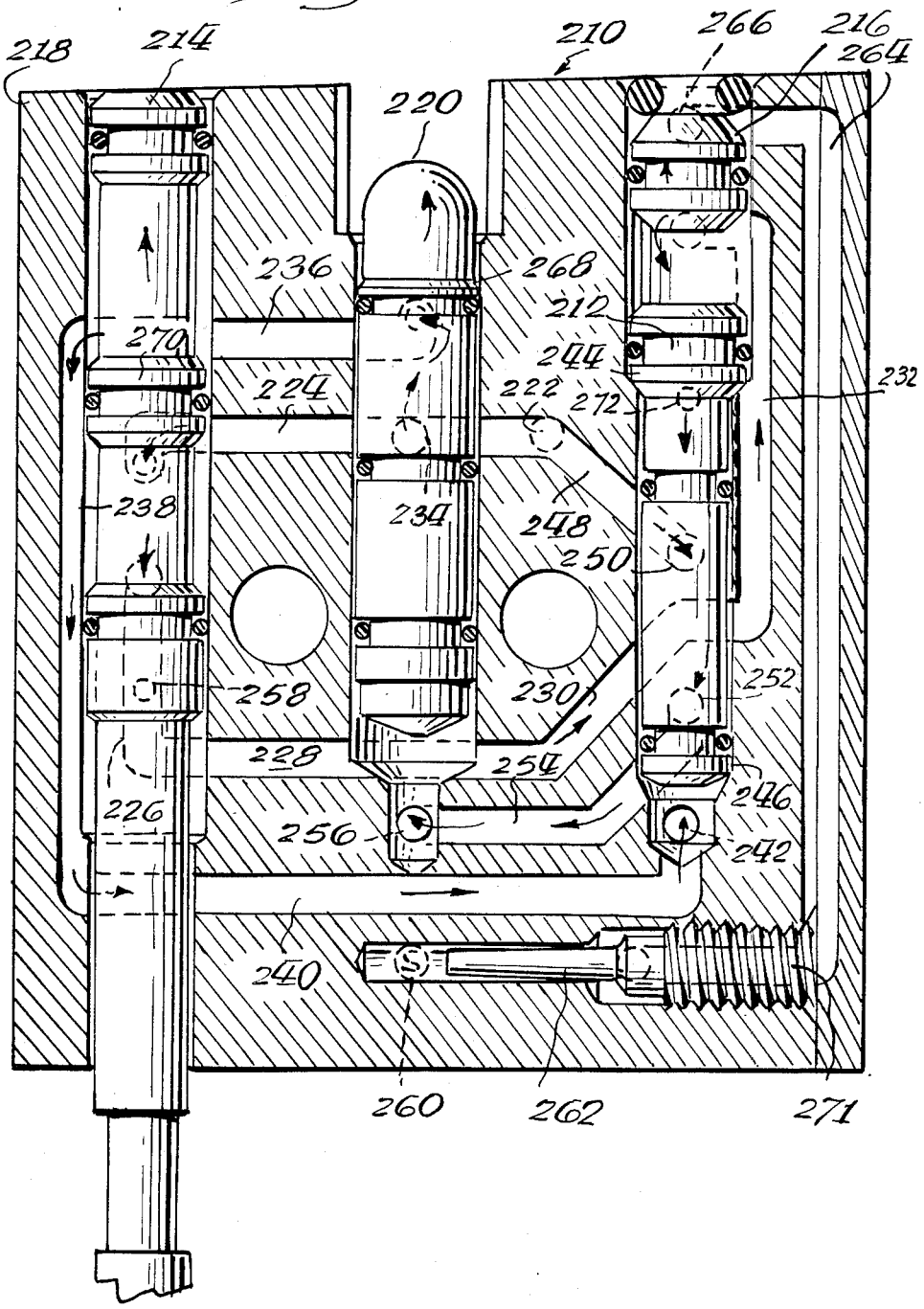
FIG. 5 is a pictorial view of a multi-shot sequential fire control valve for a fastener driving tool of the type illustrated in FIG. 1 wherein the valve is constructed in accordance with the principles of the present invention; the valve is illustrated in the static mode.

The multi-shot sequential fire circuitry is illustrated in FIGS. 5–9. The static mode of control valve 210 is illustrated in FIG. 5. Valve 210 includes a housing 218 in which the safety 214, cycle valve 212, plug valve 216 and trigger valve 220 are positioned. Reservoir air enters valve 210 at port 222 and is communicated through passage 224, along safety 214, and through passages 226, 228, 230 and 232 to the top of cycle valve 212 to bias it down to the static position. Reservoir air is also communicated through trigger valve 220 to the bottom of cycle valve 212 through passage 224 to port 234, along trigger valve 220 and through passages 236, 238 and 240 to port 242. Cycle valve 212 is vented to atmosphere through port 272 between opposing air diameters 244 and 246 and remains in the static position.

Reservoir air is communicated to dump valve 24 and the bottom of trigger valve 220 by way of cycle valve 212. Reservoir air flows from port 222 through passage 248, into port 250, along cycle valve 212, through port 252, through passage 254 and into port 256 that is in communication with the bottom of trigger valve 220 and the dump valve 24.

Figure 6:
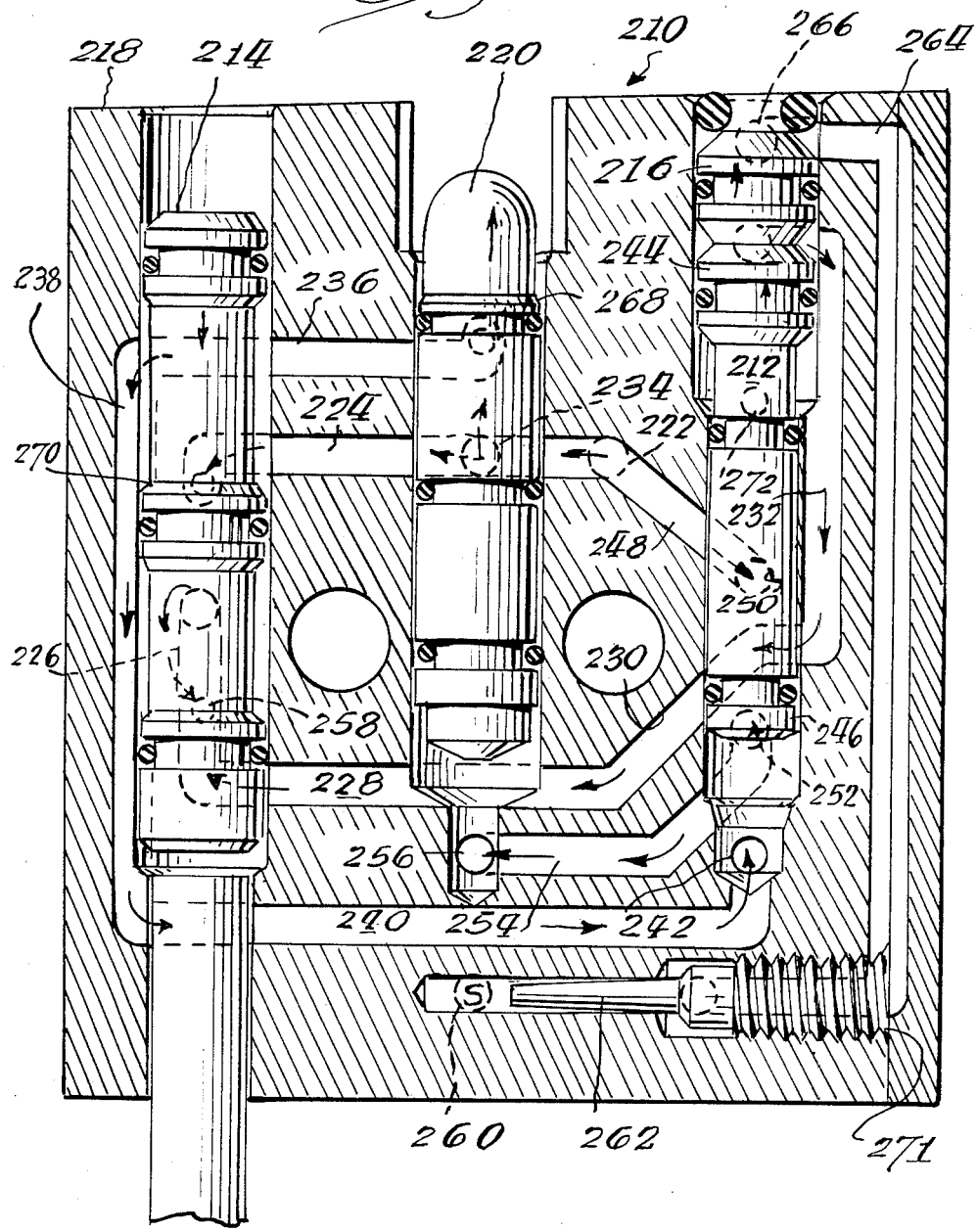
FIG. 6 is a view similar to FIG. 5 with the valve housing in the first fire mode.
Figure 7:
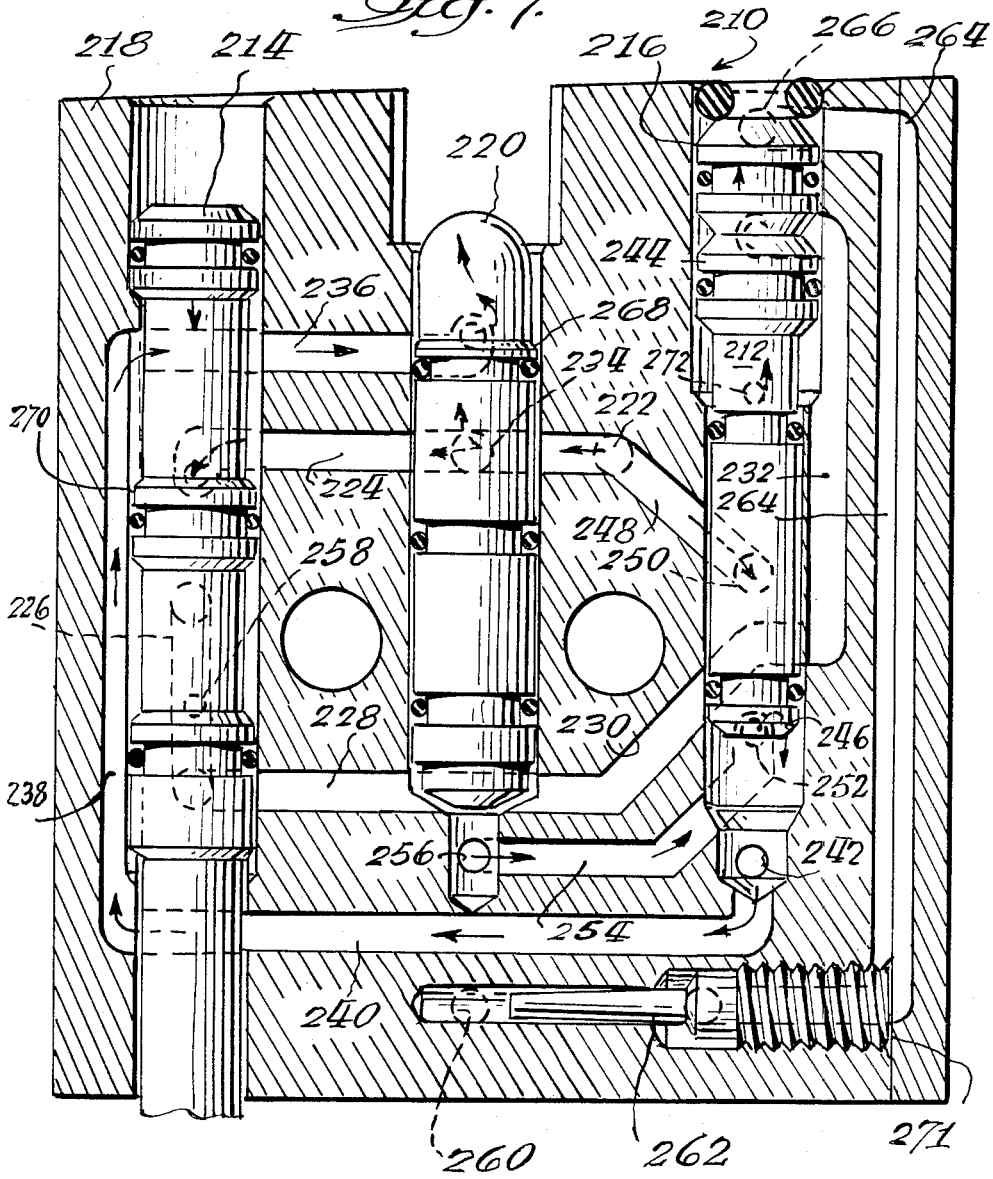
FIG. 7 is a view similar to FIG. 6 in the second fire mode.
Figure 8:
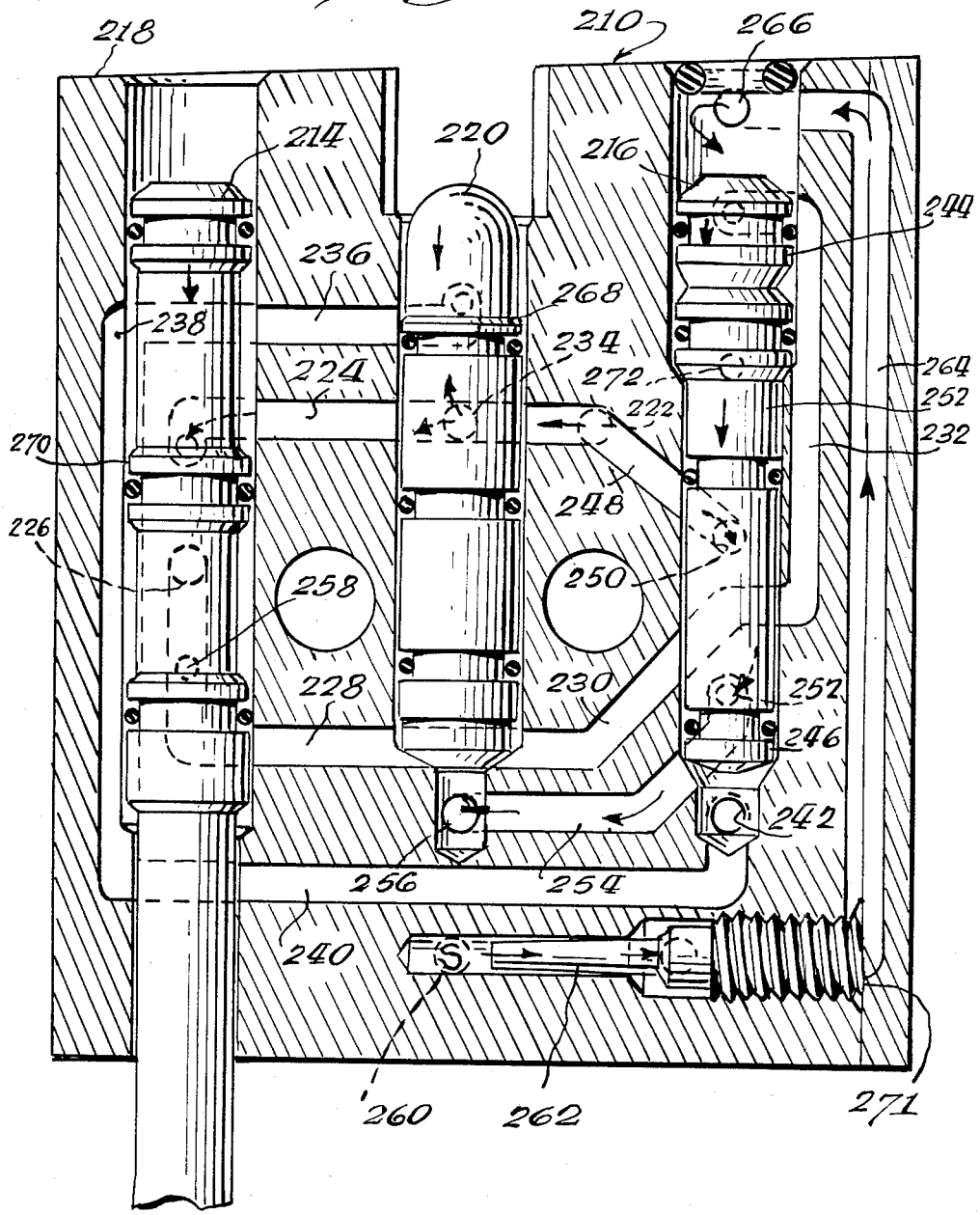
FIG. 8 is a view similar to FIGS. 5–7 in the return mode.

To prepare tool 10 for firing, it is placed against a workpiece shifting safety 214 down to an active position (FIG. 6). This movement cuts off the reservoir air biasing the cycle valve 212 down by cutting off communication between passages 224 and 226. Passage 226 is communicated with atmosphere through port 258. Reservoir air circulating through trigger valve 220 and passages 236, 238 and 240 to the bottom of cycle valve 212 biases cycle valve 212 up to the active position. Reservoir air is now circulating to dump valve 24 solely through trigger valve 220. As trigger valve 220 is actuated to the down position (FIG. 7), reservoir air to the dump valve 24 is terminated and the air in dump valve 24 is vented from passage 236 to atmosphere around trigger valve 220. Tool 10 then fires.

After tool 10 fires, a signal from return chamber 100 is communicated to port 260 (FIG. 8). The signal pressure flows through needle valve 262 and passage 264 to port 266 located above plug valve 216. Plug valve 216 moves down moving cycle valve 212 to the static position to recycle tool 10. Reservoir air is then able to flow from port 222, through passage 248 and port 250, along cycle valve 212 and passage 254 to dump valve 24 through port 256 and to the bottom of trigger valve 220. Tool 10 can now be fired again without lifting tool 10 from the workpiece by actuation of trigger 86.

Figure 9:
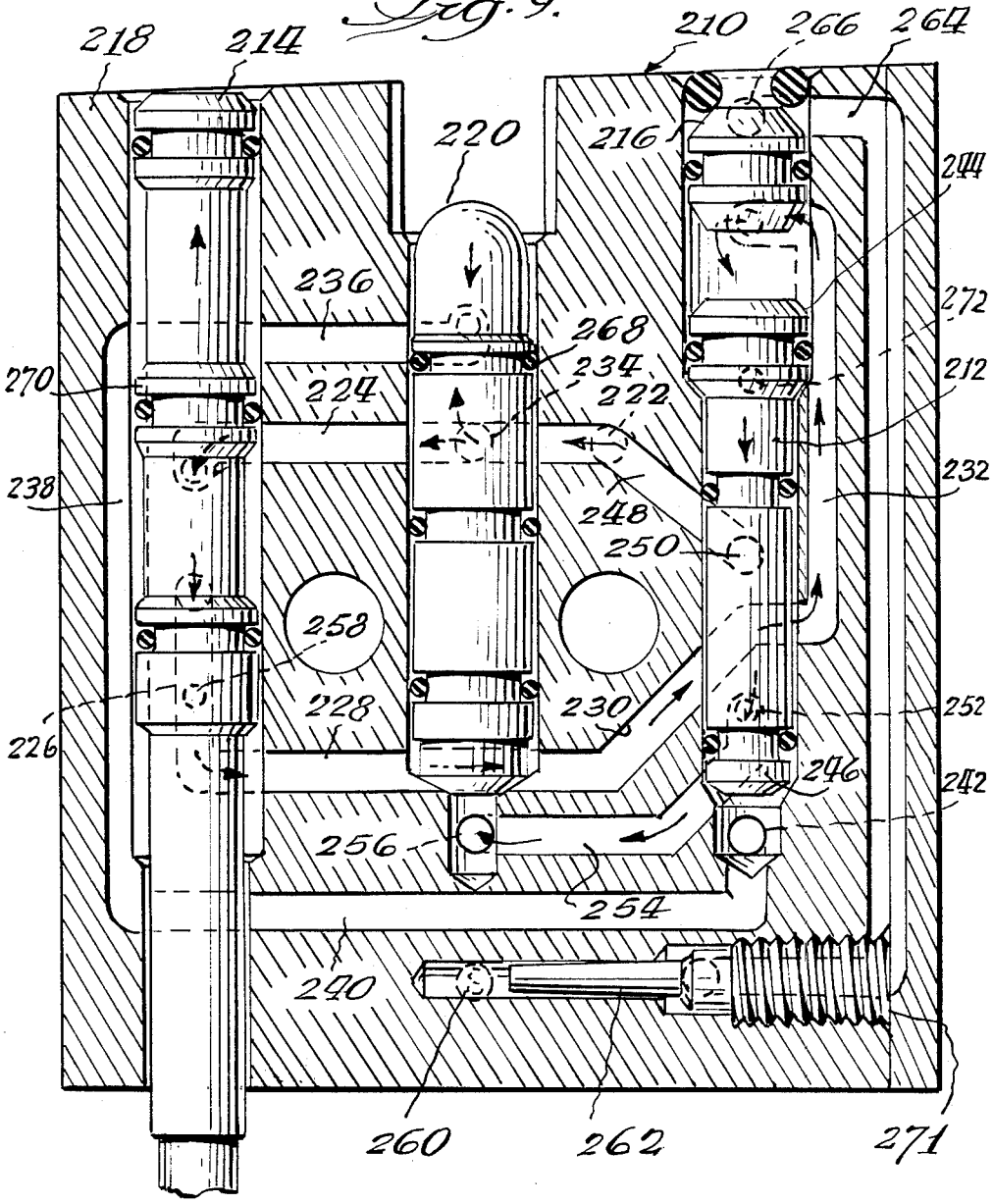
FIG. 9 is a view similar to FIGS. 5–8 illustrating an improper firing sequence.
Figure 10:
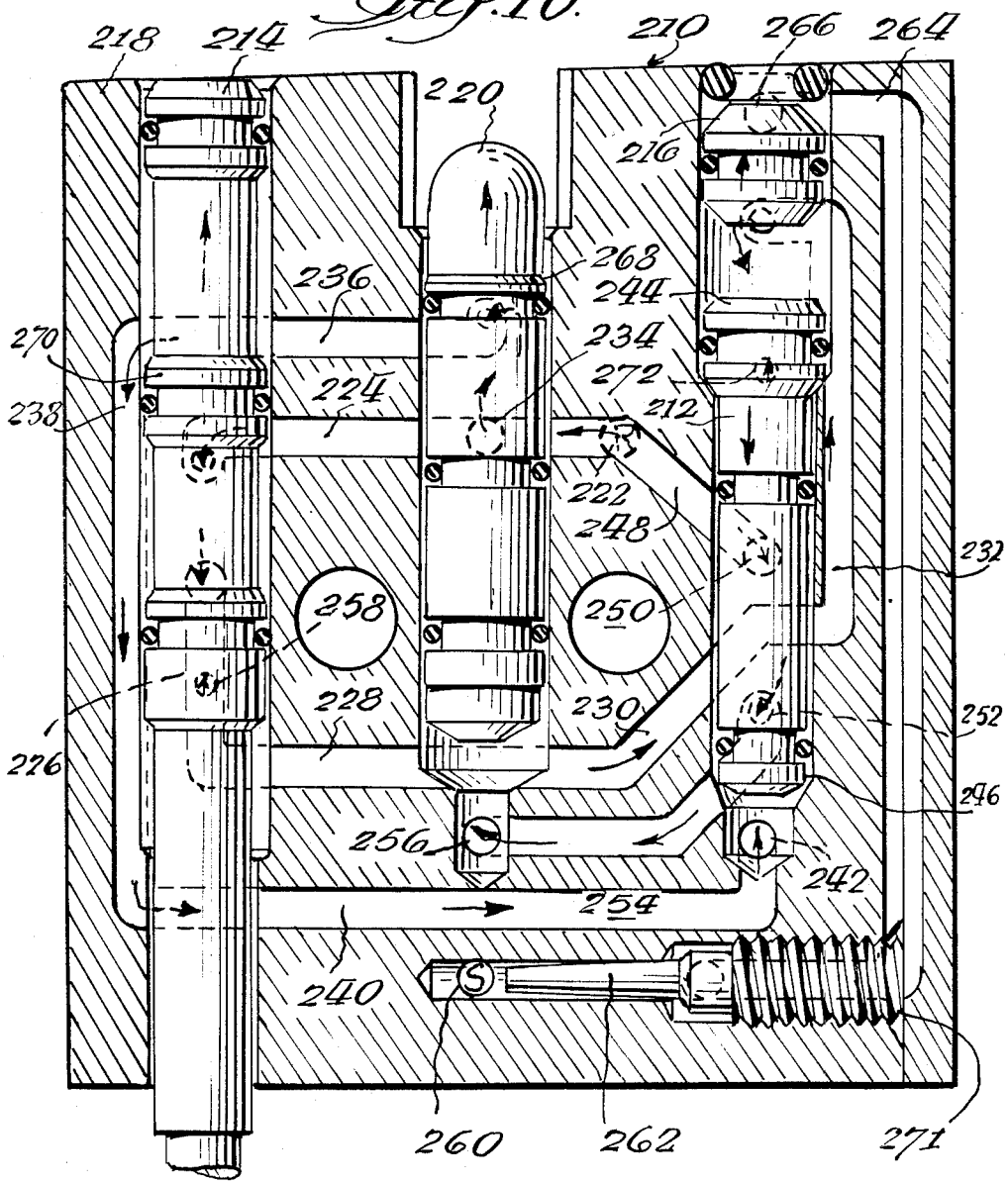
FIG. 10 is a pictorial view of a single shot sequential fire control valve constructed in accordance with the principles of the present invention and in the static mode.

If the sequential firing order is altered by actuating trigger 86 prior to safety 214, reservoir air to the bottom of cycle valve 212 is terminated (FIG. 9). Diameter 268 on trigger valve 220 is positioned between port 234 and passage 236 terminating flow of reservoir air. Once the safety 214 is depressed, diameter 270 cuts off flow between passages 224 and 226 terminating flow of reservoir air to the top of cycle valve 212. Cycle valve 212 remains in the static position and reservoir air continues to flow to dump valve 24 through port 256. Accordingly, tool 10 does not fire.

In some applications it is desirable to use tool 10 with control valve 210 for single fire sequential firing. This operation allows tool 10 to be fired only after the safety 214 has been actuated by placing tool 10 onto a workpiece followed by actuation of trigger 86. To be operated a second time, both safety 214 and trigger 86 must be released and the sequence repeated.

Tool 10 can be easily adjusted to single shot sequential firing by threading needle valve 262 into aperture 271 in valve housing 218 to seal off the return signal through port 260. Once needle valve 262 has been positioned to seal off the return signal, control valve 210 operates in the following manner to provide single shot sequential firing.

In the static mode (FIG. 10), reservoir air enters control valve 210 through port 222 and is transferred through safety 214 to passages 228, 230 and 232 to the top of the cycle valve 212 to bias it to the static position. Reservoir air is also transferred through trigger valve 220 to the bottom of cycle valve 212 through passages 236, 238 and 240. Cycle valve 212 is vented between diameters 244 and 246 to atmosphere through port 272 and it remains in the static position. Reservoir air is then transferred to dump valve 24 via cycle valve 212 through port 256.

Figure 11:
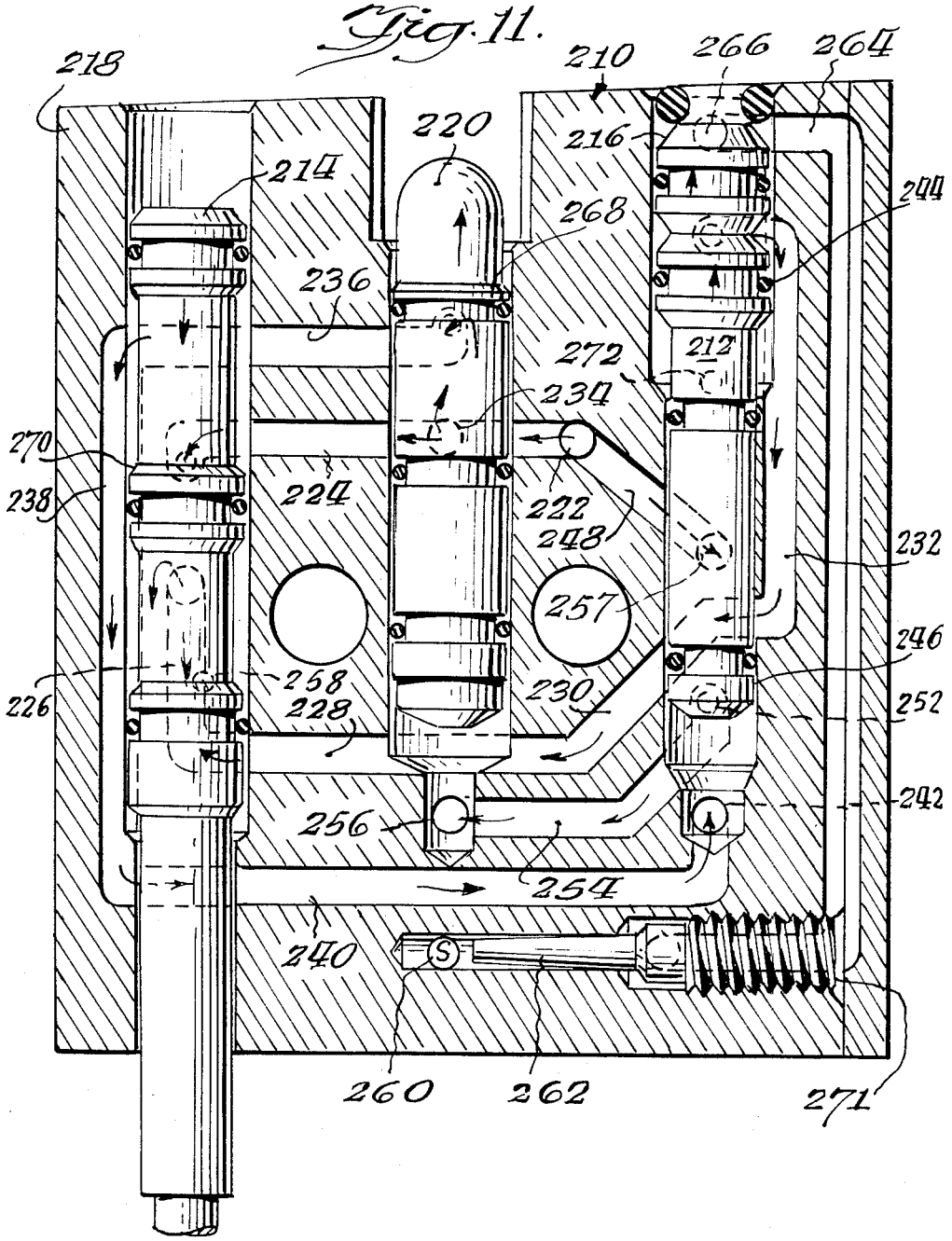
FIG. 11 is a view similar to FIG. 10 with the valve in the first fire mode.

To fire tool 10 in the proper sequential firing order, tool 10 is placed against a workpiece to move safety 214 to the active position illustrated in FIG. 11. This movement cuts off reservoir air biasing cycle valve 212 down by placing diameter 270 between passages 224 and 226 and connecting passage 226 to atmosphere through port 258.

Figure 12:
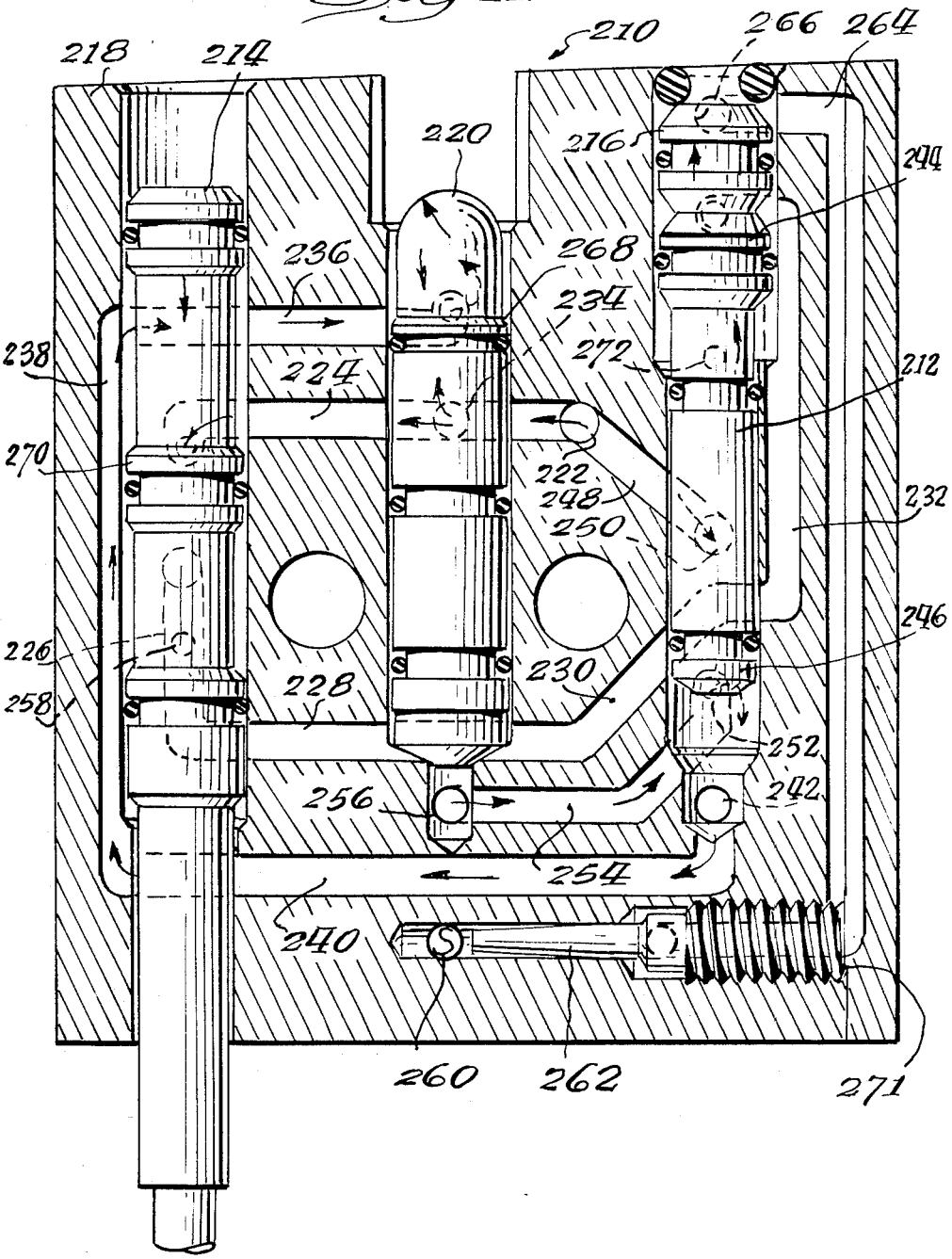
FIG. 12 is a view similar to FIG. 11 in the second fire mode.

Reservoir air circulates through trigger valve 220 to the bottom of cycle valve 212 through passages 236, 238 and 240 biasing cycle valve 212 up to the active position. Reservoir air is now circulating to the dump valve 24 solely through trigger valve 220. Trigger 86 may now be actuated moving trigger valve 220 downward to the active position (FIG. 12). Reservoir air to dump valve 24 is cut off and is vented to atmosphere along passages 254, 240, 238 and 236 and above trigger valve 220 firing the tool 110.

Figure 13:
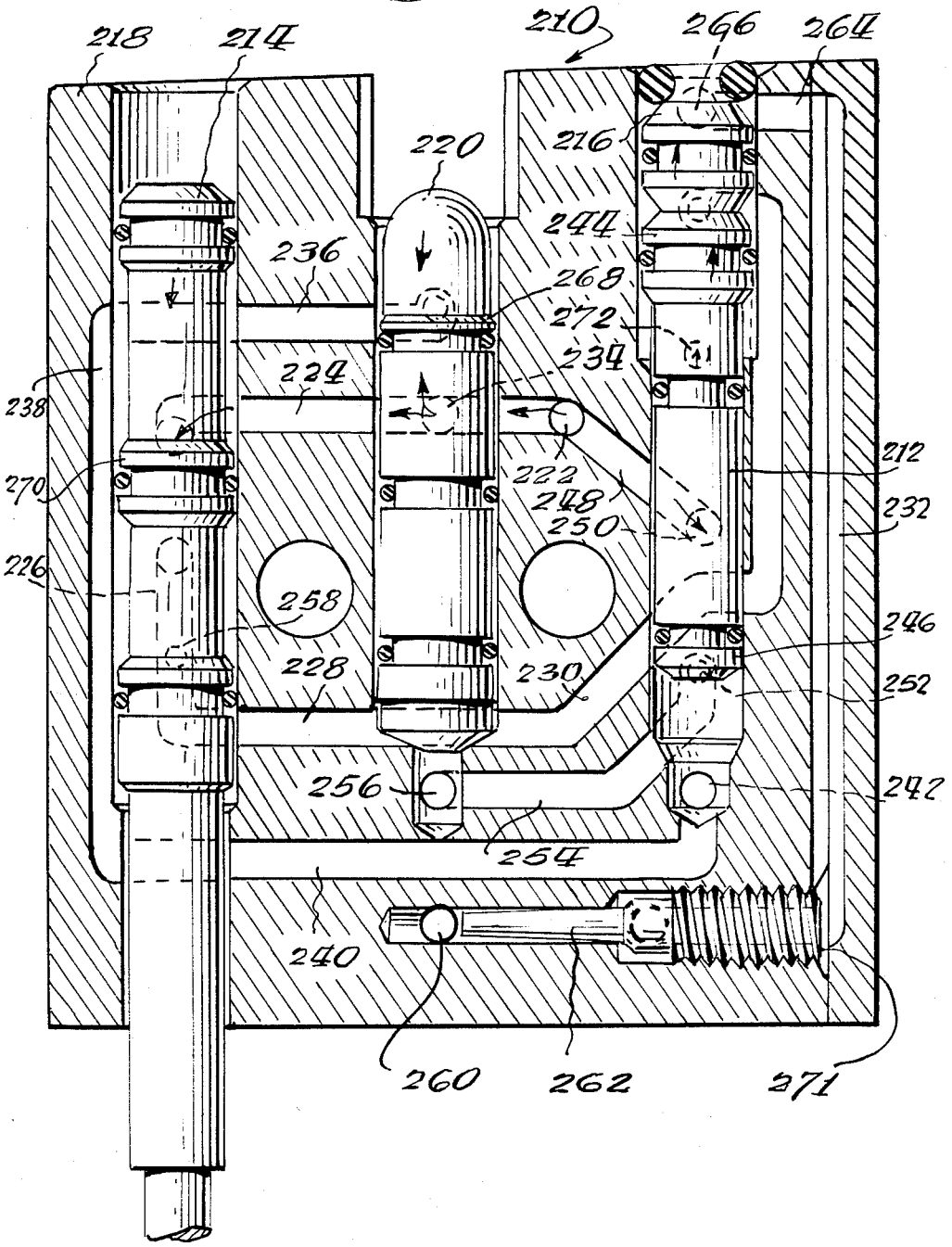
FIG. 13 is a view similar to FIGS. 10–12 in the first return mode.

After tool 10 fires, a signal from return chamber 100 enters port 260 but is cut off by needle valve 262 (FIG. 13). Tool 10 will continue to exhaust to atmosphere until a signal is received to move cycle valve 212 down to the static position. If trigger 86 is released, there is no reservoir air beneath trigger valve 220 to bias it up to the static position.

Figure 14:
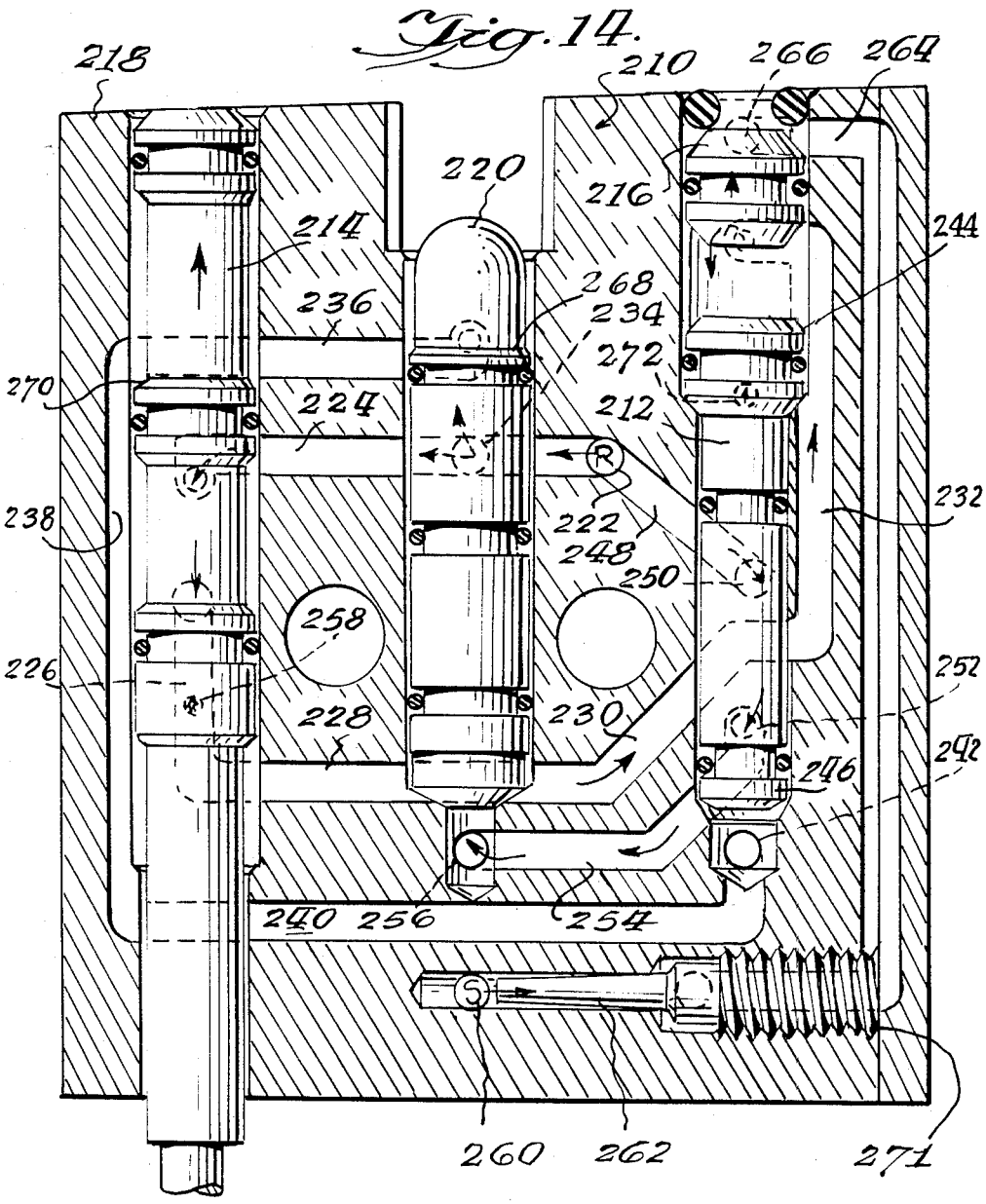
FIG. 14 is a view similar to FIG. 13 in the second return mode.

Only when safety 214 is released by lifting tool 10 from the workpiece will the tool 10 recycle (FIG. 14). Upon lifting of tool 10, reservoir air is communicated to the top of cycle valve 212 through safety 214 and passages 226, 228, 230 and 232. Reservoir air is then communicated to the dump valve 24 through passages 248 and 254 and port 256. Tool 10 is again ready to be actuated by following the proper sequence.

Figure 15:
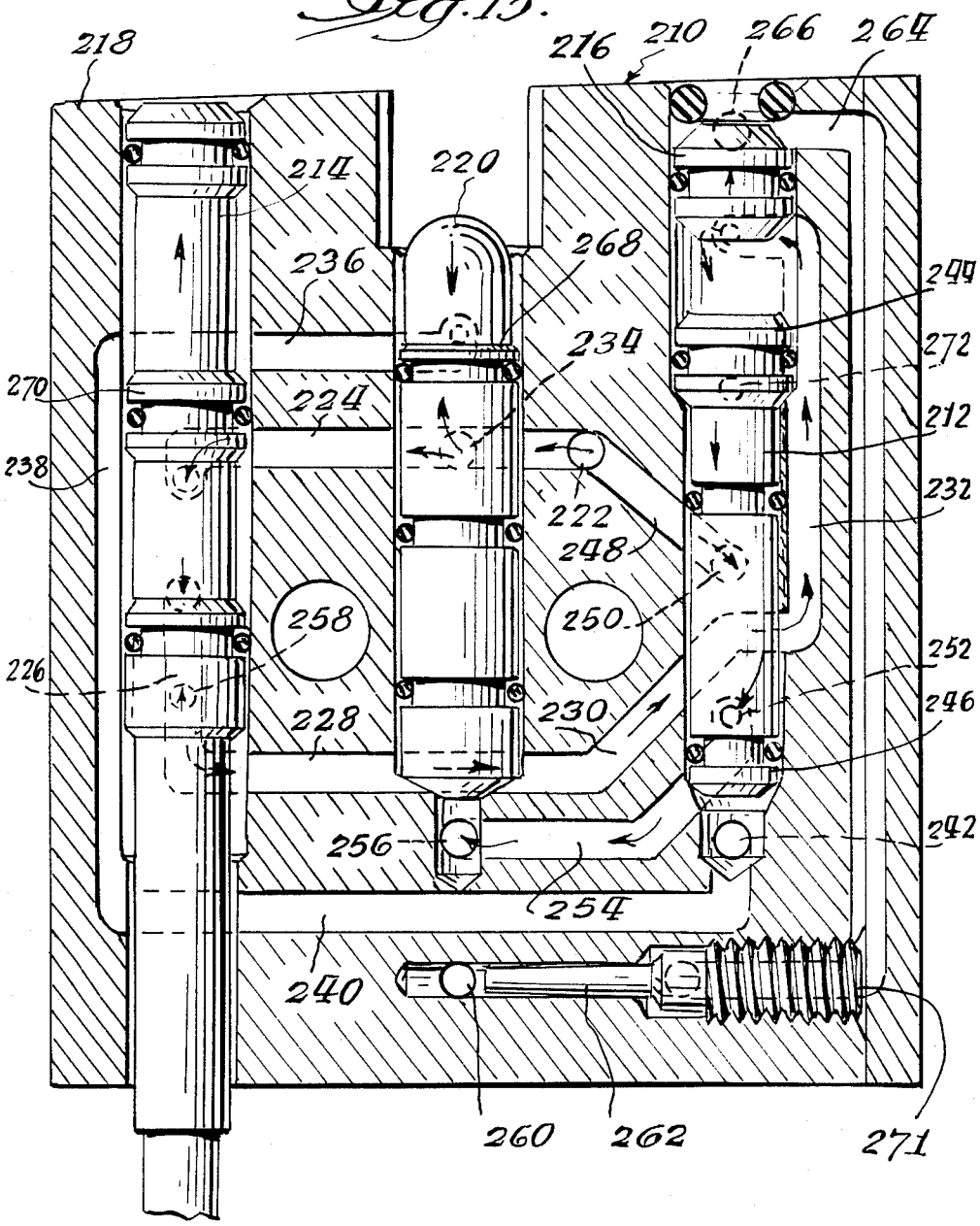
FIG. 15 is a view similar to FIGS. 10–14 illustrating an improper firing sequence.

If the sequential firing order is altered by actuating trigger 86 prior to safety 214, reservoir air to the bottom of cycle valve 212 is cut off (FIG. 15). In this position diameter 268 is located between port 234 and passage 236 preventing flow between each of them. If safety 214 is now depressed, reservoir air to the top of cycle valve 212 biases cycle valve 212 in the static position and reservoir air circulates to dump valve 24 through cycle valve 212 through passages 248 and 254 and port 256 and tool 10 does not fire.

Control valve 210, by the employment of plug valve 216, allows easy adjustment of tool 10 to either single shot or multi-shot sequential firing by the quick positioning of needle valve 262. Through this arrangement, a tool manufacturer may customize a tool 10 to the end user's requirements without costly tool alterations.

Many modifications and variations of the present invention are possible in light of the above teachings. Thus, it is to be understood that, within the scope of the appended claims, the invention may be practiced otherwise than as specifically described.

What is claimed and sought to be secured by Letters Patent of the United States is:

1. In a tool for driving fasteners into a workpiece using a pressurized fluid motor for actuating a fastener driving means, comprising:

a manually actuated trigger valve means, a safety means actuated by placing the tool adjacent the workpiece, fluid actuated valve means controlled by the trigger valve means and the safety means for controlling the application of pressurized fluid to the fluid motor, and control means interconnecting said trigger valve means and said safety means selectively actuable to a first mode preventing operation of the fluid actuated valve means unless said safety means is first actuated followed by the actuation of the trigger valve means whereupon the sequence must be repeated for repeated operation of said fluid actuated valve means and to a second mode allowing repeated operation of the fluid actuated valve means upon repeated actuation of said trigger valve means after first actuating said safety means.

2. The tool set forth in claim 1 wherein said control means includes a cycle valve in fluid communication with said pressurized fluid at a first end through said trigger valve and at a second end through said safety means.

3. The tool set forth in claim 2 further comprising means for returning said fastener driving means at the completion of a driving stroke, a plug valve adjacent said cycle valve with a first end in fluid communication with said pressurized fluid through said safety means and a second end in communication with said returning means.

4. The tool set forth in claim 3 further comprising a needle valve in said tool between said returning means and said plug valve for controlling fluid flow therebetween.

5. The tool set forth in claim 4 wherein said needle valve is adjustable to a plurality of positions controlling said flow of pressurized fluid.

6. A fastener driving tool, comprising:

a housing defining a fluid reservoir, means for driving a fastener, a fluid motor in said housing for actuating said driving means in response to communication of fluid from said reservoir to said fluid motor, control means for controlling the communication of fluid from said reservoir to said fluid motor, said control means including a trigger valve in fluid communication with said reservoir, a safety and a cycle valve assembly, said control means preventing operation of said fluid motor unless said safety is first actuated followed by actuation of said trigger valve, means for signaling said control means to return said drive means after said actuation, and means for selectively communicating a signal from said signaling means to said cycle valve assembly to allow repeated actuation of said drive means after actuating said safety followed by repeated actuation of said trigger valve in a first mode and to allow only a single actuation of said drive means after actuation of safety followed by actuation of said trigger valve in a second mode.

7. The fastener driving tool claimed in claim 6 wherein said selectively communicating means includes a needle valve.

8. The fastener driving tool claimed in claim 6 further comprising a plug valve in said control means, said plug valve including a first end in a fluid communication with said signaling means and a second end in fluid communication with said reservoir through said safety.

9. The fastener driving tool claimed in claim 8 wherein said plug valve is adjacent said cycle valve with said second end of said plug valve adjacent said cycle valve.

10. A tool for driving a fastener into a workpiece, comprising:

a housing defining a fluid reservoir, means for driving a fastener, a fluid motor in said housing for actuating said driving means, a return assembly in said housing for returning said driving means after the completion of a driving stroke, a control assembly on said tool for controlling the flow of fluid from said reservoir to said fluid motor, said control assembly including a trigger valve, a safety, a cycle valve and a plug valve, means for communicating fluid from said return assembly to said plug valve, and means for selectively controlling fluid flow through said communicating means to control the mode of operation of said tool between a single shot sequential fire mode and a multi-shot sequential fire mode.

11. The tool set forth in claim 10 wherein said selective control means comprises a needle valve.

12. The tool set forth in claim 10 wherein said plug valve includes a first end in communication with fluid from said return assembly, said plug valve including a second end adjacent said cycle valve, and means for communicating fluid from said reservoir through said safety to between said second end of said plug valve and said cycle valve.

* * * * *